US005467974A

United States Patent [19]

Ishiwata et al.

[11] Patent Number: 5,467,974

[45] Date of Patent: Nov. 21, 1995

[54] PAPER SHEET STACKING MECHANISM FOR MAIL SORTING SYSTEM

[75] Inventors: Tadashi Ishiwata; Tetsuo Ogata; Ikuhiro Aota, all of Tokyo, Japan

[73] Assignee: NEC Corporation, Tokyo, Japan

[21] Appl. No.: 258,826

[22] Filed: Jun. 13, 1994

[30] Foreign Application Priority Data

Jun. 11, 1993 [JP] Japan ..... 5-140792

[51] Int. Cl.[6] ..... B65H 31/26

[52] U.S. Cl. ..... 271/220; 271/177; 271/207

[58] Field of Search ..... 271/207, 220, 271/223, 224, 177

[56] References Cited

U.S. PATENT DOCUMENTS

| | | | |
|---|---|---|---|
| 2,991,999 | 7/1961 | Doerner | 271/220 |
| 3,537,704 | 5/1968 | Bond | 271/177 |
| 3,942,786 | 3/1976 | Lauren | 271/177 |
| 4,441,702 | 4/1984 | Nagel et al. | 271/177 |
| 4,903,956 | 2/1990 | Stephens et al. | 271/220 X |
| 5,260,759 | 11/1993 | Kobayashi | 271/220 X |
| 5,332,210 | 7/1994 | Silverberg et al. | 271/220 |

FOREIGN PATENT DOCUMENTS

| | | | |
|---|---|---|---|
| 0552779 | 7/1993 | European Pat. Off. | 271/177 |
| 0232367 | 11/1985 | Japan | 271/220 |
| 0027870 | 2/1986 | Japan | 271/220 |
| 0264161 | 11/1987 | Japan | 271/220 |
| 63-143172 | 6/1988 | Japan . | |
| 0267666 | 11/1988 | Japan | 271/220 |
| 4094369 | 3/1992 | Japan | 271/220 |

*Primary Examiner*—William E. Terrell
*Assistant Examiner*—Carol L. Druzbick
*Attorney, Agent, or Firm*—Young & Thompson

[57] ABSTRACT

The upper end of a movable plate for guiding paper sheets is fitted to a shaft on which the plate swings, and is suspended in a slit provided in a stacking box. The movable guide plate and a supporting plate are in a positional relationship in which the angle θ formed by them is at a certain prescribed degree, and even if relatively heavy sheets are deposited and hit against the movable guide plate, the plate will not be flipped up because it is supported by the supporting plate. When the stack of the sheets sufficiently increases in volume to reach the lower end of the movable guide plate, the upper end of the plate slides along the slit along with the further deposition of sheets, so that the angle θ formed by the movable guide plate and the supporting plate increase to deprive the latter from its supporting function, and the supporting plate, together with the movable guide plate, are pressed upward as the stack of sheets further increases in volume. For this reason, sheets can be stacked to the full capacity of the stacking box.

11 Claims, 10 Drawing Sheets

PAPER SHEET STACKING MECHANISM FOR MAIL SORTING SYSTEM

BACKGROUND OF THE INVENTION

1. Field of the Invention

The present invention relates to a paper sheet stacking mechanism, and more particularly to a paper sheet stacking mechanism for a partitioned box to classify mail by destination in a mail sorting system.

2. Description of the Related Art

Before turning to the present invention it is deemed advantageous to briefly discuss known paper sheet stacking mechanisms with reference to FIGS. 1 and 2.

FIG. 1 shows a paper sheet tracking mechanism. A guide plate 101 is fixed to a top plate 102 of a stacking box 100 to guide deposited sheets 103 toward the bottom of the stacking box 100 installed with an inclination in the direction in which the sheets 103 are to be carried.

However, in this sheet stacking mechanism whose guide plate 101 is fixed to the top plate 102 of the stacking box 100, since the sheets 103 can be stacked no farther than the position of the bottom end of the guide plate 101, it is limited to stack the sheets 103 from bottom of the stacking box 100 to the bottom end of the guide plate 101, resulting in the problem of a correspondingly reduced stacking capacity.

Means to solve this problem is disclosed in the Gazette of Patent Disclosure No. 1988-143172. In this means, as illustrated in FIG. 2, in order to guide deposited sheets 203 toward the bottom of a stacking box 200 installed with an inclination in the direction in which the sheets 203 are to be carried, a guide plate 202 is fitted swingably to a fixed guide plate 201 fixed to the top plate 204 of the stacking box 200.

The sheets 203, as they are carried, are guided by the fixed guide plate 201 and the guide plate 202 to be stacked on the bottom of the stacking box 200. When the stacked volume of the sheets 203 exceeds a prescribed level, the swingable guide plate 202 is pressed upward.

However, in this stacking mechanism disclosed in the Gazette of Patent Disclosure No. 1988-143172, although the stacking capacity is not reduced because the guide plate 202 is pressed upward according to the volume of stacked sheets 203, there is the problem of inability to reliably guide the sheets when relatively heavy sheets are deposited into the stacking box 200, which would let the guide plate flip up.

SUMMARY OF THE INVENTION

An object of the present invention is to provide a paper sheet stacking mechanism having a function to reliably guide even heavy paper sheets for a certain period of time so that all the sheets deposited can be steadily guided and yet a large sheet stacking capacity can be secured.

In order to achieve the aforementioned object, according to the invention, there is provided a paper stacking mechanism to be installed within a stacking box into which paper sheets deposited through a depositing inlet are to be stacked, having: a movable guide plate, pivoting on and supported by a first shaft provided on the top plate of the stacking box, for guiding the deposited sheets; a supporting plate of which one end pivots on a second shaft provided on the top plate and the other end is positioned in contact with the face opposite to the depositing inlet to prevent said movable guide plate from being swung by the sheets deposited through the depositing inlet; and a releasing mechanism for disengaging, when the volume of stacked sheets has surpassed a prescribed level, the function of said supporting plate to prevent the movable plate from being swung.

By using this configuration, a paper sheet stacking mechanism according to the invention has a function to reliably guide heavy paper sheets for a certain period of time so that jamming of sheets can be prevented and, furthermore, its collapsible structure allows paper sheets to fill the stacking box and the capacity of the stacking box to be correspondingly enlarged.

BRIEF DESCRIPTION OF THE DRAWINGS

The present invention will be described in further detail below with reference to the accompanying drawings, in which.

DETAILED DESCRIPTION OF THE PREFERRED EMBODIMENTS

Figure 1:
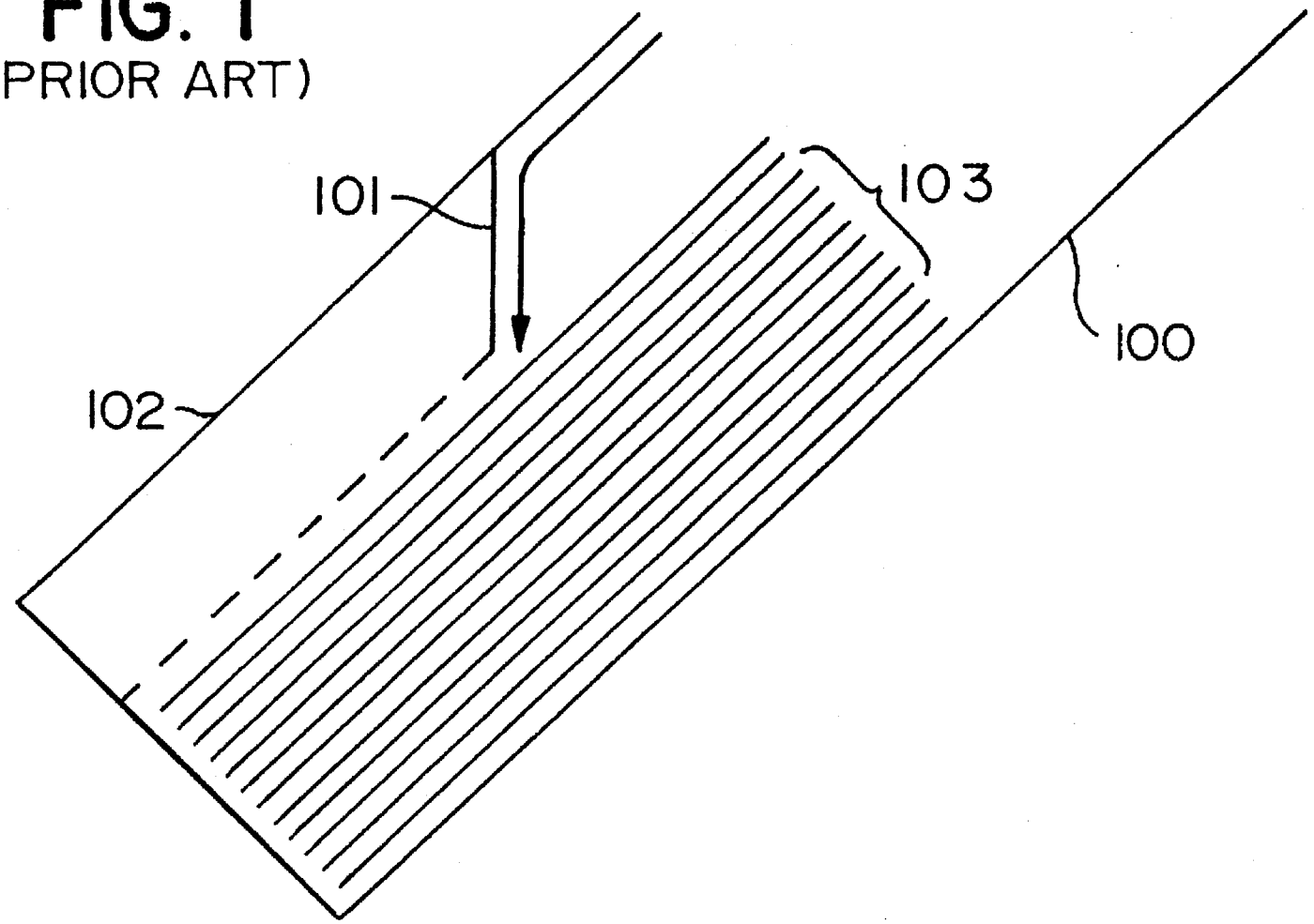
FIG. 1 (PRIOR ART)
FIG. 1 is a sectional view showing a conventional paper sheet stacking mechanism.
Figure 2:
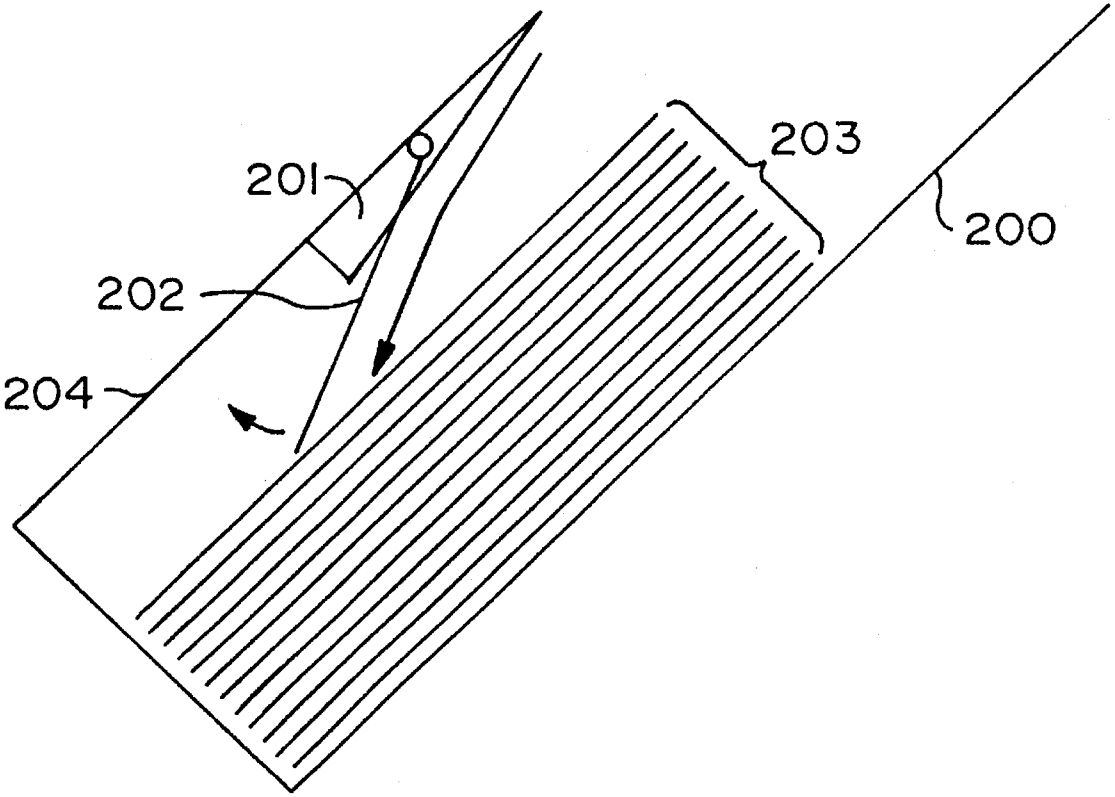
FIG. 2 (PRIOR ART)
FIG. 2 is a sectional view showing another conventional paper sheet stacking mechanism.
Figure 3:
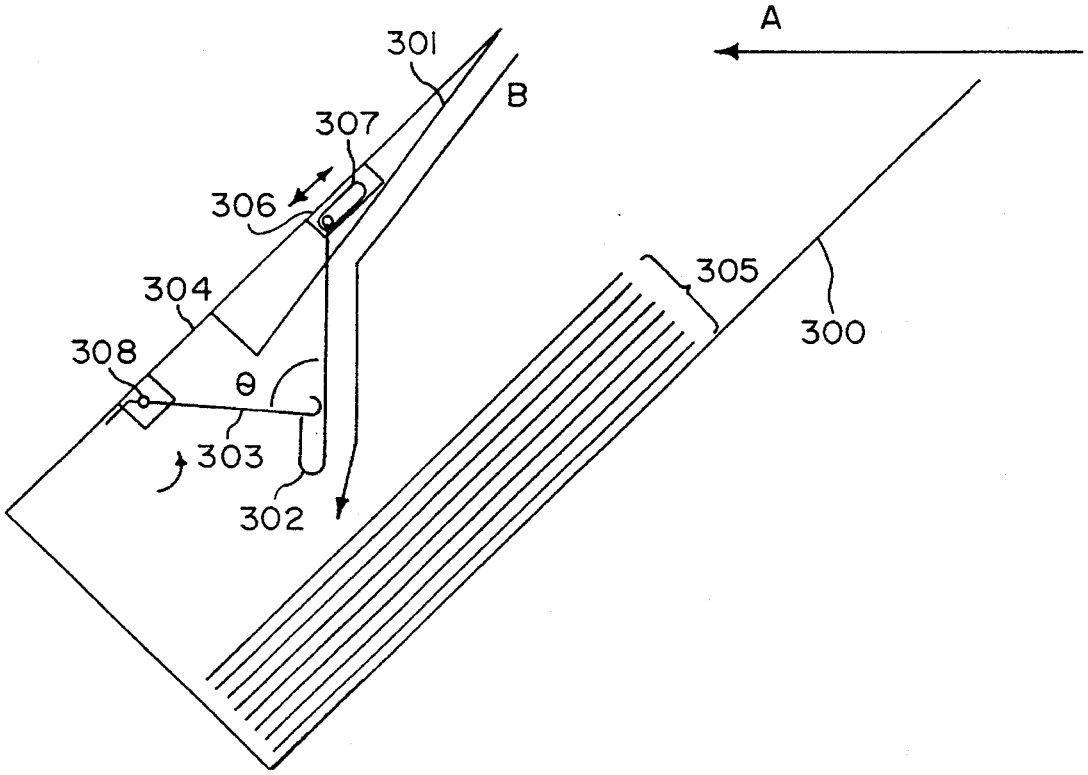
FIG. 3 is a sectional view showing a first preferred embodiment of the invention.

Referring to FIG. 3, a stacking box 300 in a first preferred embodiment of the present invention is fitted with a fixed guide plate 301, a movable guide plate 302 and a supporting plate 303.

The fixed guide plate 301, fitted to the top plate 304 of the stacking box 300, guides deposited sheets 305 to the movable guide plate 302. The upper edge of the movable guide plate 302 is fitted to a shaft 306 provided within a slit 307 formed on the top plate 304 of the stacking box 300, and pivots on the shaft 306, which can slide along the slit 307 in the direction of the arrow in the diagram. The lower end of the movable guide plate 302 is folded toward the supporting plate 303 as illustrated.

The upper end of the supporting plate 303 is fitted to a shaft 308 provided on the stacking box 300, and its lower end, also folded in the same manner as that of the movable guide plate 302, is positioned above the folded part of the movable guide plate 302 and on the side opposite to the sheets 305.

The stacking box 300 in this embodiment is to be installed, as illustrated, with an inclination in the direction A in which the sheets 305 are carried, and the movable guide plate 302 hangs down perpendicularly when the sheets 305 are not stacked and accordingly there is no interference by them.

The end of the supporting plate 303 on the side opposite to the movable guide plate 302 is bent so that the angle it forms with the top plate of the stacking box 300 do not exceed a prescribed degree, and the supporting plate 303 is so configured as to be able to turn only in the upward direction in the diagram. The prescribed angle of this supporting plate 303 is so set that an angle θ formed by the supporting plate 303 and the movable guide plate 302 maintains a prescribed degree in the absence of interference by the sheets 305 as shown in FIG. 3 and that the force working on the movable guide plate 302 when the movable guide plate 302 turns away from the sheets 305 works toward the shaft 308 of the supporting plate 303. Accordingly, the force of the movable guide plate 302 to press the supporting plate 303 with the deposited sheets 305 is received by the shaft 308 of the supporting plate 303 to prevent the movable guide plate 302 from turning.

Here, the folded lower end of said movable guide plate 302 serves to press the supporting plate 303 upward to increase the increment of the angle e. Therefore, the top end of this folded part should be in a position to press the supporting plate 303 upward when said movable guide plate 302 is pressed upward by the stacked sheets 305. Thus, this folded part requires a certain width to keep away from the end of the folded part of the supporting plate 303, and the edge of the folded part of the movable guide plate 302 should be immediately below the supporting plate 303.

Next will be described the operation of this preferred embodiment in detail with reference to FIGS. 3 through 6.

First, the sheets 305 are deposited from a prescribed position of the stacking box 300 and stacked, guided by the fixed guide plate 301 and the movable guide plate 302 as indicated by arrow B in the diagram.

As illustrated in FIG. 3, until the stack of the sheets 306 reaches the lower end of the movable plate 302, the angle θ formed by the movable plate 302 and the supporting plate 303 maintains a prescribed degree. Accordingly, even though the movable guide plate 302 is pressed by the deposited sheets 305, the direction of the force with which the movable guide plate 302 presses the supporting plate 303 is not varied by that pressure, and the movable guide plate 302 is prevented by the supporting plate 303 from inclining toward the side opposite to the depositing inlet. Therefore, even if heavy sheets 305 are deposited into the stacking box 300 and hit against the movable guide plate 302, the movable guide plate 302 is not flipped away, but continues to guide the sheets 305.

Figure 4:
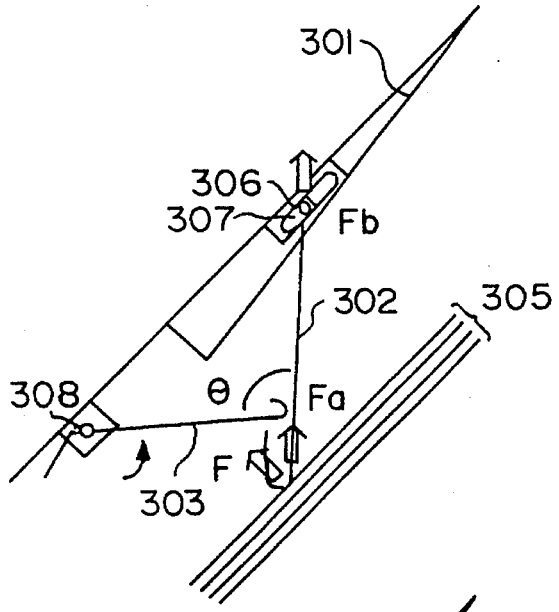
FIGS. 4 through 6 are showing consecutively the stacking operation of the first embodiment.

When the accumulation of the sheets 305 has made sufficient progress for their stack to reach the lower end of the movable guide plate 302 as shown in FIG. 4, any sheets 305 deposited after that enter between the lower end of the movable guide plate 302 and the uppermost one of the already stacked sheets 305. Here, the force with which the sheets 305 press the movable guide plate 302 upward being represented by F, a force Fb in the lengthwise direction of the slit 307 is generated on the shaft 306 at the upper end of the movable guide plate 302 by an arrowed force Fa, which is the component of the force F along the movable guide plate 302. This shaft 306, since it is within the slit 307, is slid for the force Fb toward the inlet of the stacking box 300. Along with the sliding of this shaft 107, the lower end of the movable guide plate 103 is pressed upward by the deposited sheets 305, with the upper end of the movable guide plate 302 pivoting on the sliding shaft 306. The sliding of the upper end and the raising of the lower end of the movable guide plate 302 increase the angle θ formed by the movable guide plate 302 and the supporting plate 303.

Then, because the lower end of the movable guide plate 302 is folded, the supporting plate 303 is raised, pivoting on the shaft 308 at its upper end, simultaneously as the lower end of the movable guide plate 302 is pressed Upward, and the increment of the angle θ is thereby increased. After the stack of the sheets 305 reaches the lower end of the movable guiding plate 302, further depositing of the sheets 305 gradually increases the angle θ.

Figure 5:
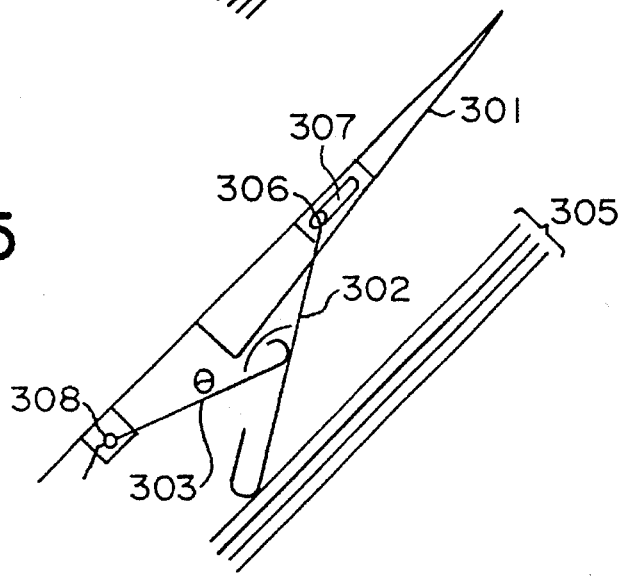

When the accumulation of the sheets 305 further progresses, the angle θ formed by the movable guide plate 302 and the supporting plate 303 reaches a certain degree as shown in FIG. 5, the direction of the force with which the movable guide plate 302 presses the supporting plate 303 turns toward the upper part of the diagram, where the supporting plate 303 can swing. The lower end of the supporting plate 303 is thereby caused to ride on the movable guide plate 302, and the supporting plate 303 no longer supports the movable guide plate 302. When heavy sheets 305 are deposited in this state, the movable guide plate 302 is deprived of its guiding mechanism, and flipped upward. As the sheets 305 are further stacked, the movable guide plate 302 and the supporting plate 303, each pivoting on the shaft at its upper end, are pressed upward. In this state, since the unoccupied space in the stacking box 300 is already small as stated above, further deposited sheets 305 are guided by the already deposited sheets 305, so that even heavy sheets 305 behave stably within the stacking box 300, instead of being stacked disorderly or interfering with next deposited sheets 305 to invite jamming.

Figure 6:
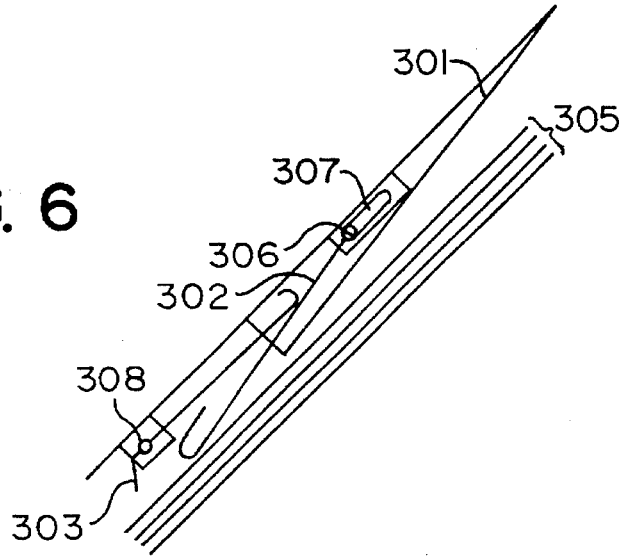

As described above, the sheets 305 are stacked to the position of the lower end of the movable guide plate 302 when it and the supporting plate 303 are folded as illustrated in FIG. 6 or to the position of the lower end of the fixed guide plate 301.

Next will be explained the prescribed angle θ formed by the movable guide plate and the supporting plate with reference to FIGS. 3 and 4.

Whereas the optimal degree of the prescribed angle θ depends on, among other factors, the length of the slit 307 and the coefficieny of friction between the contacting parts of the movable guide plate 302 and the supporting plate 303, an essential point is that when the shaft 308 is in the lower part of the slit 307 as shown in FIG. 3, i.e. in a state where the movable guide plate 302 is supported by the supporting plate 303, the prescribed angleθ should be less than 90°. If the prescribed angle θ is definitely smaller than its desirable degree, even if the prescribed angle θ increases along with the accumulation of the sheets 305, the direction of the force with which the movable guide plate 302 presses the supporting plate 303, on account of the smaller initial value of the prescribed angle θ, does not increase to a degree at which the supporting plate 303 turns toward the upper part of the diagram, where the supporting plate 303 can swing. As a consequence, the movable guide plate 302 cannot be smoothly released from the support by the supporting plate 303, the movable guide plate 302 does not rise with the accumulation of the sheets 305, and further deposited sheets 305 become stuck between the movable guide plate 302 and the already stacked sheets 305, thereby inviting jamming.

On the other hand, if the prescribed angle θ is definitely greater than its desirable degree, the timing of the release of the movable guide plate 302 from the support by the supporting plate 303 is advanced on account of the greater initial value of the prescribed angle θ. As a consequence, deposited heavy sheets 105 cannot be reliably guided for a certain period of time, and this also becomes a cause of jamming.

Furthermore, when the shaft 306 is in the upper part of the slit 307 as shown in FIG. 4, i.e. in a state where the stack of sheets has surpassed a prescribed volume to release the movable guide plate 302 from the support by the supporting plate 303, the prescribed angle θ should be more than 90°.

Next will be described a second preferred embodiment of the present invention.

Figure 7:
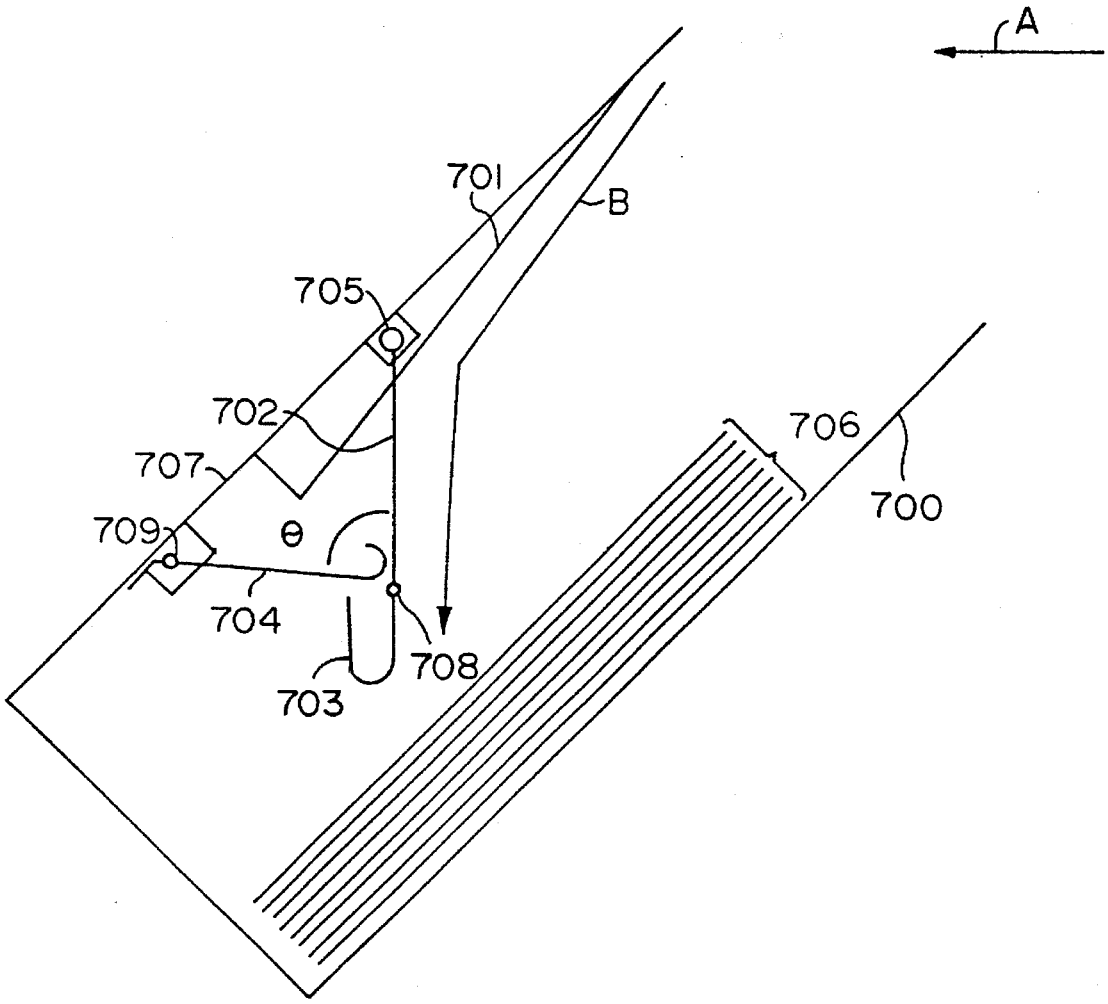
FIG. 7 is a sectional view showing a second preferred embodiment of the invention.

Referring to FIG. 7, the top plate 707 of a stacking box 700 for stacking and storing paper sheets 706 in the second embodiment of the invention is provided with a fixed guide plate 701 and a shaft 705. A movable guide plate 702 is suspended from the shaft 705 so as to be able to swing, pivoting on one of its ends. At the other end of the movable guide plate 702 is provided another shaft 708, from which a flip-up plate 703 is suspended swingably.

The flip-up plate 703 is folded back halfway, and one of its ends is positioned exactly below one end of a supporting plate 704. The supporting plate 704 is suspended swingably from a shaft 709 provided in the top plate of the stacking box 700, and its open end, which is folded back in the same manner as the flip-up plate 703, is positioned immediately behind the movable guide plate 702.

The stacking box 700 in this embodiment is to be installed, as illustrated, with an inclination in the direction A in which the sheets 706 are carried, and the movable guide plate 702 hangs down perpendicularly when the sheets 706 are not stacked and accordingly there is no interference by them.

The end of the supporting plate 704 on the side opposite to the movable guide plate 702 is bent so that the angle it forms with the top plate of the stacking box 700 does not exceed a prescribed degree, and the supporting plate 704 is so configured as to be able to turn only in the upward direction in the diagram. The prescribed angle of this supporting plate 704 is so set that an angle θ formed by the supporting plate 704 and the movable guide plate 702 maintains a prescribed degree in the absence of interference by the sheets 706 as shown in FIG. 7 and that the force working on the movable guide plate 702 when the movable guide plate 702 turns away from the sheets 706 works toward the shaft 709 of the supporting plate 704. Accordingly, the force of the movable guide plate 702 to press the supporting plate 704 with the deposited sheets 706 is received by the shaft 709 of the supporting plate 704 to prevent the movable guide plate 702 from turning.

Next will be described the operation of this preferred embodiment in detail with reference to FIGS. 7 through 10.

First, as shown in FIG. 7, the sheets 706 are deposited from a prescribed position of the stacking box 700 and stacked, guided by the fixed guide plate 701 and the movable guide plate 702. Until the stack of the sheets 706 reaches the lower end of the flip-up plate 703, the angle θ formed by the movable plate 702 and the supporting plate 704 maintains a prescribed degree. Accordingly, even though the movable guide plate 702 is pressed by the deposited sheets 706, the force with which the movable guide plate 702 presses the supporting plate 704 is not dispersed, and the movable guide plate 702 is prevented by the supporting plate 704 from inclining toward the side opposite to the depositing inlet. Therefore, even if heavy sheets 706 are deposited into the stacking box 700 and hit against the movable guide plate 702, the movable guide plate 702 is not flipped away, but continues to guide the sheets 706.

Figure 8:
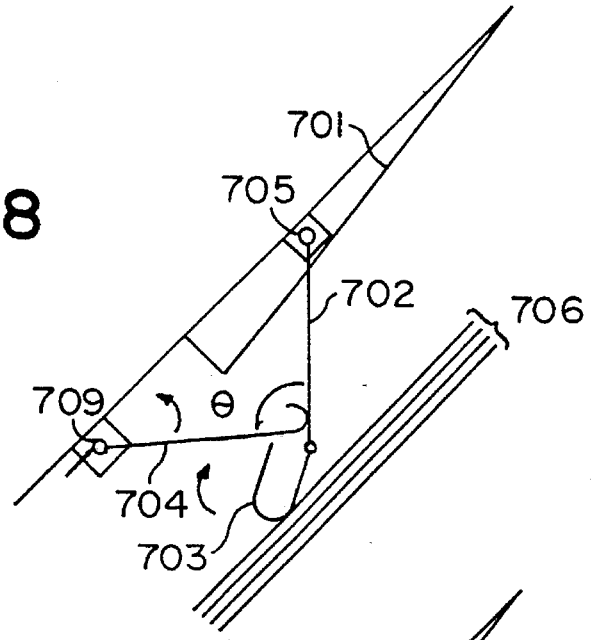
FIGS. 8 through 10 are showing consecutively the stacking operation of the second embodiment.
Figure 9:
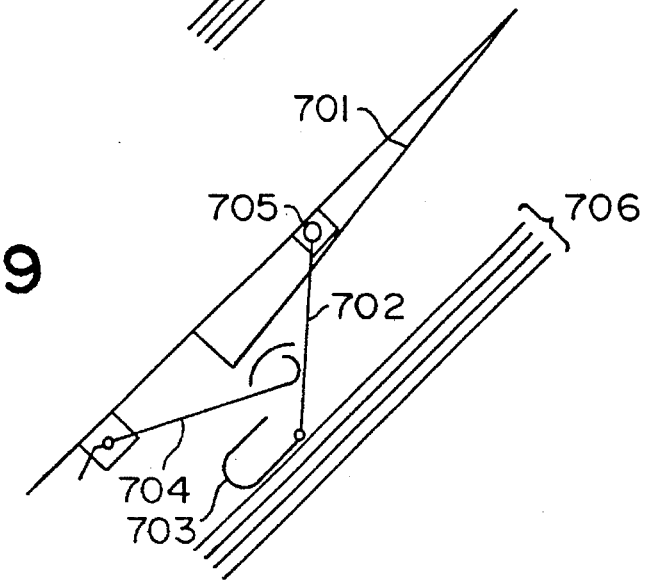

When the accumulation of the sheets 706 has made sufficient progress for their stack to reach the lower end of the flip-up plate 703 as shown in FIG. 8, any sheets 706 deposited after that enter between the lower end of the flip-up plate 204 and the already stacked sheets 105, simultaneously press the flip-up plate 703. Here, the flip-up plate 703, as one of its ends is positioned exactly below the supporting plate 704, presses the supporting plate 704 further upward, to increase the angle θ formed by the movable guide plate 702 and the supporting plate 704.

When the accumulation of the sheets 706 further progresses, the angle θ formed by the movable guide plate 702 and the supporting plate 704 reaches a certain degree, the direction of the force with which the movable guide plate 702 presses the supporting plate 704, as in the first preferred embodiment, turns toward the upper part of the diagram, where the supporting plate 704 can swing. The lower end of the supporting plate 704 is thereby caused to ride on the movable guide plate 702, and the supporting plate 704 no longer supports the movable guide plate 702. When heavy sheets 706 are deposited in this state, the movable guide plate 702 is deprived of its guiding mechanism, and flipped upward. As the sheets 706 are further stacked, the movable guide plate 702 and the supporting plate 704, pivoting on the shafts 705 and 709 at their respective upper ends, are pressed upward.

Figure 10:
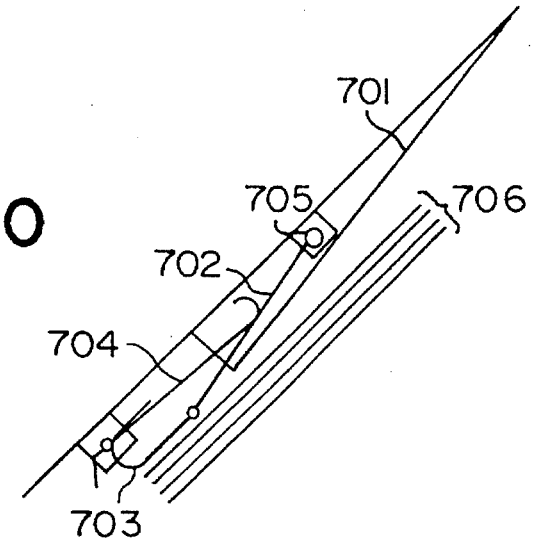

As described above, the sheets 706 are stacked to the position of the lower end of the movable guide plate 702 when it and the supporting plate 704 are folded as illustrated in FIG. 10 or to the position of the lower end of the fixed guide plate 701.

Next will be described, with reference to FIGS. 11 and 12, third and fourth preferred embodiments of the present invention, in which a stacking box is installed horizontally unlike in the foregoing first and second embodiments, in which the stacking box is inclined.

Figure 11:
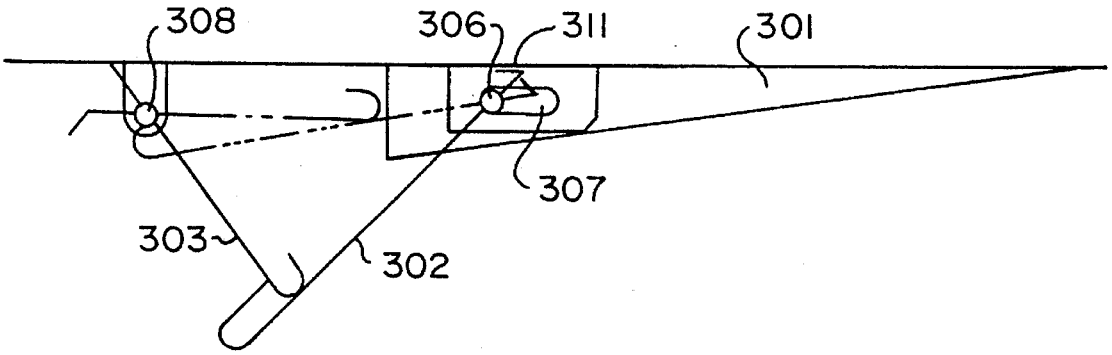
FIG. 11 shows a profile of a third preferred embodiment of the invention.

Referring to FIG. 11, to the end of a movable guide plate 302 on the side of its shaft 306 is attached a buffering member 311, which, even though a stacking box is installed horizontally, prevents the movable guide plate 302 from hanging down perpendicularly, makes it possible to keep the angle θ formed by the movable guide plate 302 and a supporting plate 303 at a desirable degree, and enables this third preferred embodiment to perform reliably a similar operation to what is performed by the foregoing first embodiment.

Figure 12:
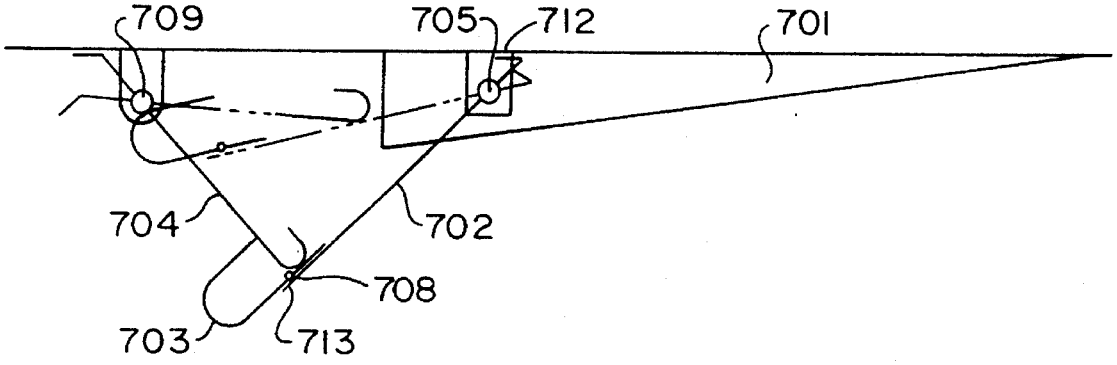
FIG. 12 shows a profile of a fourth preferred embodiment of the invention.

Referring to FIG. 12, a buffering member 712 to be attached to the end of a movable guide plate 702 on the side of its shaft 705 is the same as the buffering member 311 in the above-described third embodiment. In this embodiment, another buffering member 713 is further attached to the lower part of the shaft 708 of a flip-up plate 703 to be provided at the lower end of the movable guide plate 702. This buffering member 713, even though a stacking box is installed horizontally, prevents the flip-up plate 703 from hanging down perpendicularly, and enables this fourth preferred embodiment to perform reliably a similar operation to what is performed by the foregoing second embodiment.

Therefore, if the paper sheet stacking mechanism has the configuration of either the third or the fourth preferred embodiment described above, there will be no particular limitation to the angle in which the stacking box is to be installed. The key point is that, so as to prevent the movable guiding plate from being moved by the pressure of stacked sheets, the arrangement should be so designed that the force with which the movable guiding plate presses the supporting plate in the position where the former comes into contact with the latter be in the direction of the shaft on which the supporting plate swings. If this point is observed, the angle in which the stacking box is installed will pose no particular problem.

Next will be described, with reference to FIGS. 13 through 16, fifth and sixth preferred embodiments of the present invention having means to alter the timing of the release of the movable guide plate from the support by the supporting plate.

Figure 13:
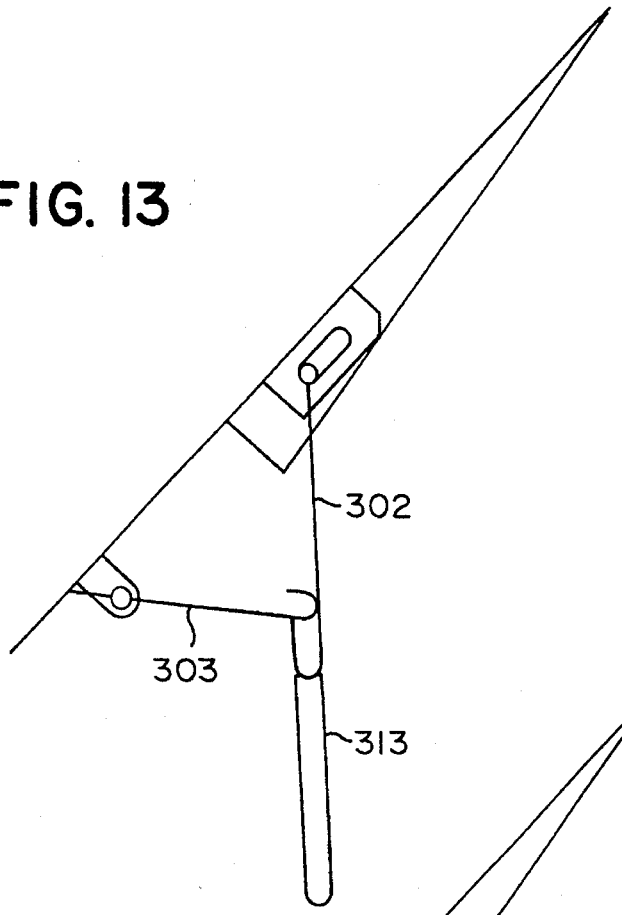
FIG. 13 shows a profile of a fifth preferred embodiment of the invention.
Figure 14:
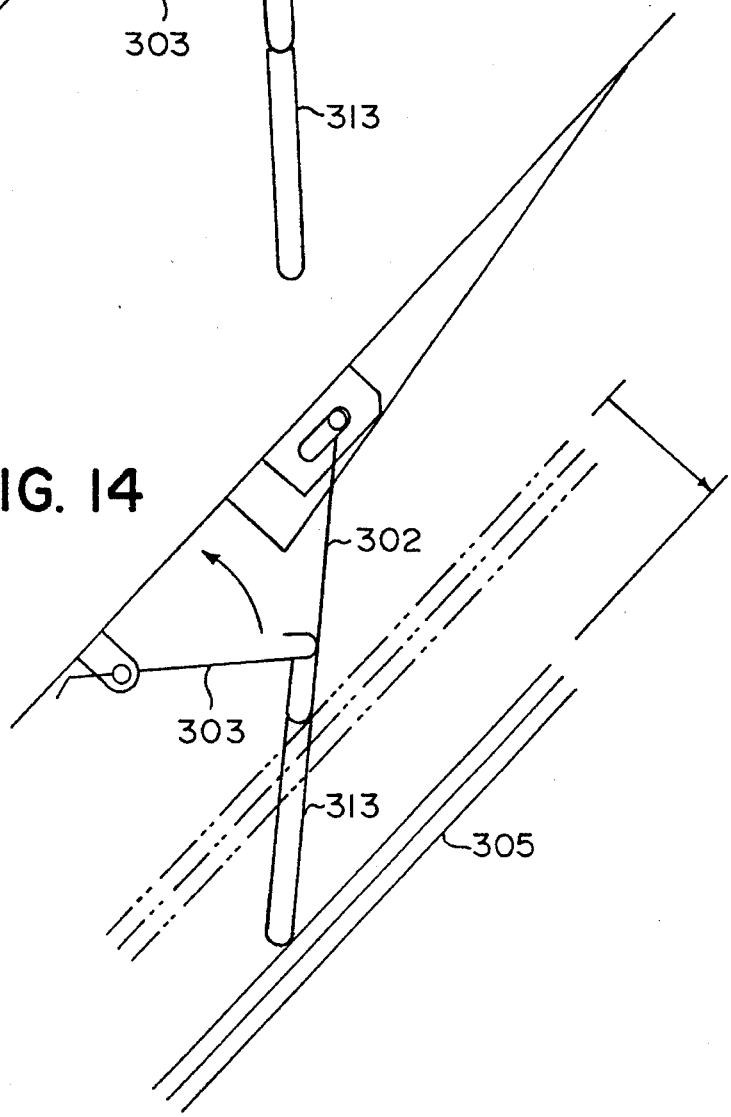
FIG. 14 is a diagram illustrating the operation of the fifth embodiment.

As illustrated in FIGS. 13 and 14, the fifth embodiment has a release position adjusting member 313 at the lower end of the movable guiding plate 302 of the paper sheet stacking mechanism of the aforementioned first embodiment. This release position adjusting member 313 can adjust with its length the timing at which the movable guiding plate 302 is released from the support by the supporting plate 303. Thus, as shown in FIG. 14, by attaching the release position adjusting member 313 to the lower end of the movable guide plate 302, it is made possible to reduce the volume of sheets 305 stacked by the time of release and thereby to advance the timing at which the movable guide plate 302 is released from the support by the supporting plate 303.

Figure 15:
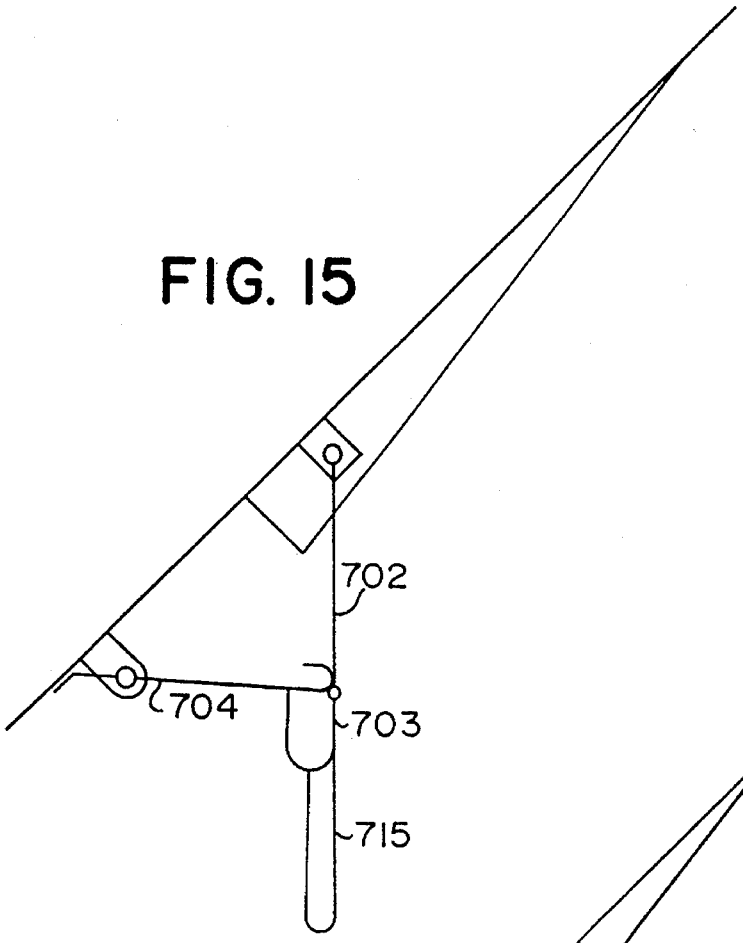
FIG. 15 shows a profile of a sixth preferred embodiment of the invention.
Figure 16:
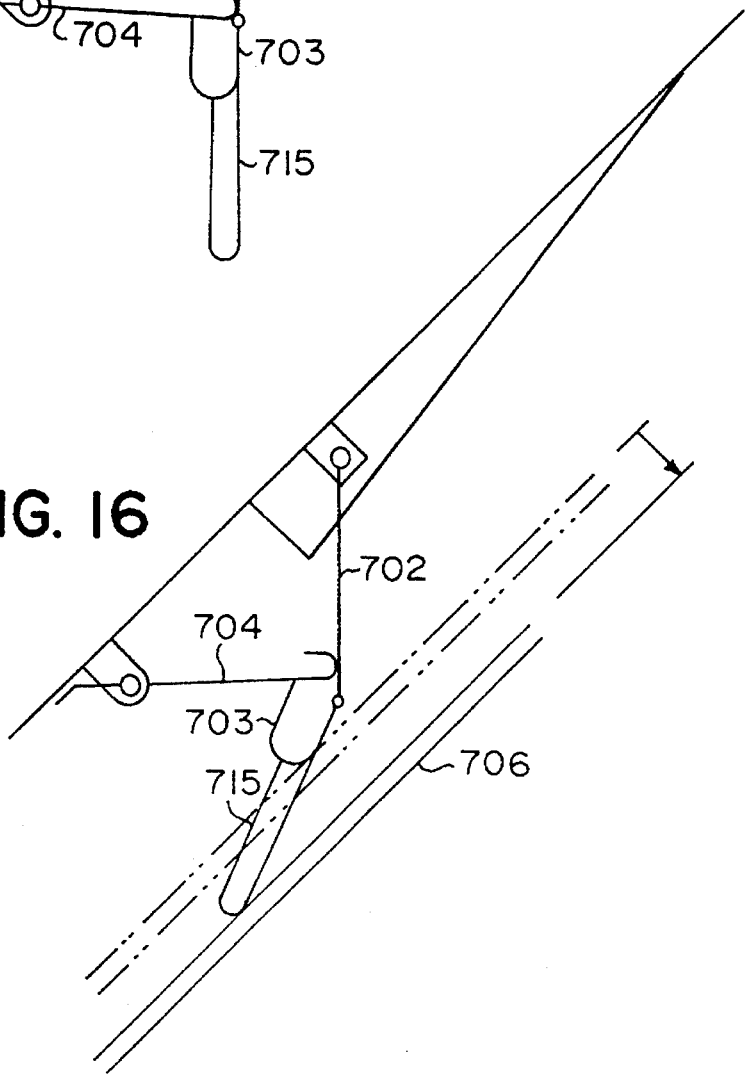
FIG. 16 shows a diagram illustrating the operation of the sixth embodiment.

The sixth embodiment, as illustrated in FIGS. 15 and 16, has a release position adjusting member 715 at the lower end of a flip-up plate 703 fitted swingably to the lower end of a movable guide plate 702. This release position adjusting member 715 is similar to the release position adjusting member 313 in the foregoing fifth embodiment. Regarding the operation of this sixth embodiment too, as shown in FIG. 16, by attaching the release position adjusting member 715 to the lower end of the flip-up plate 703, it is made possible to reduce the volume of sheets 706 stacked by the time of release and thereby to advance the timing at which the movable guide plate 702 is released from the support by the supporting plate 704.

Next will be described an example of paper sheet sorting system using a sheet stacking mechanism according to the present invention.

Figure 17:
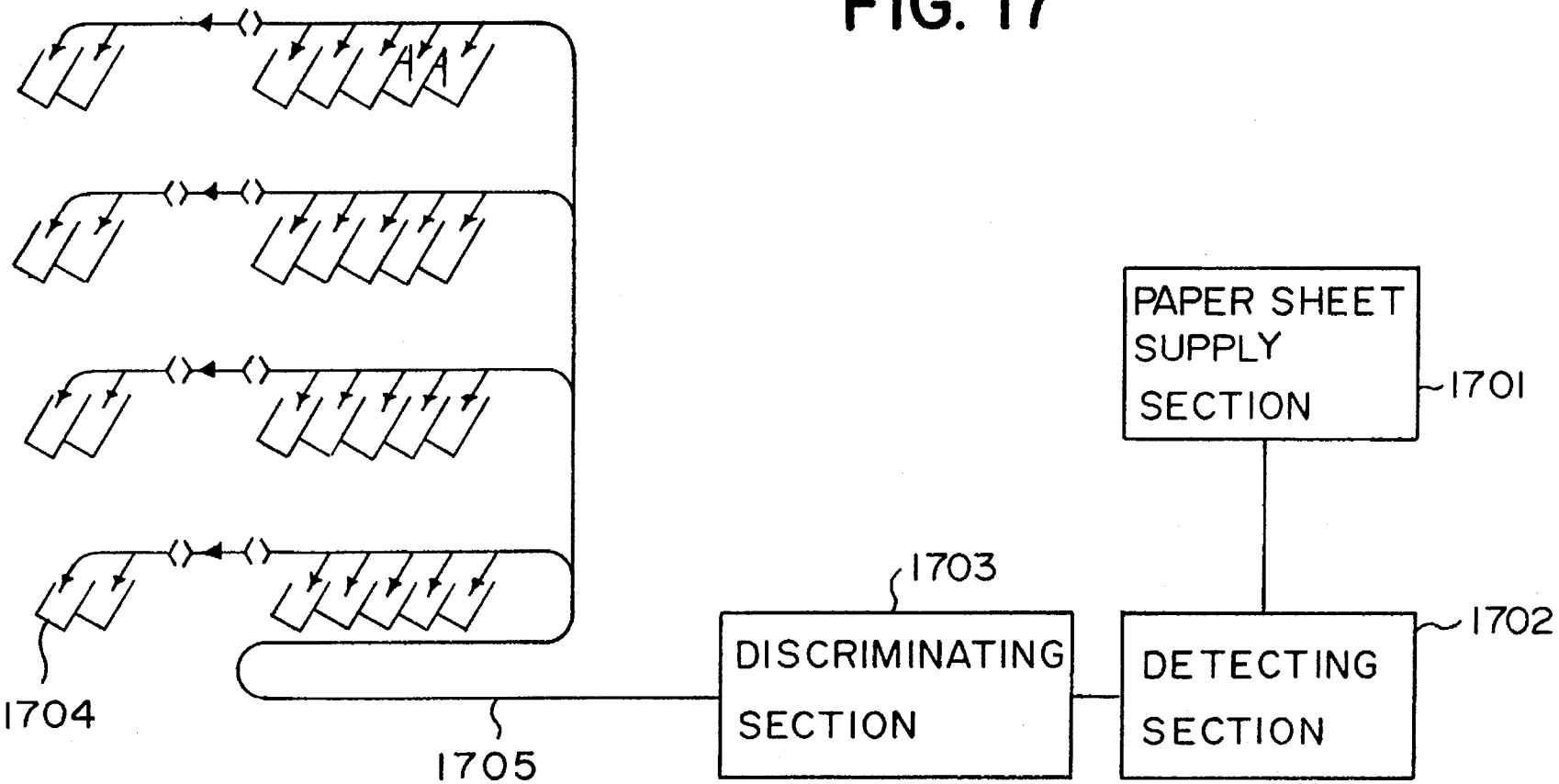
FIG. 17 is a diagram illustrating the configuration of a paper sheet sorting system according to the invention.

FIG. 17 is a diagram illustrating the configuration of one example of paper sheet shorting system according to the invention. A paper sheet supply section 1701 automatically forwards set paper sheets one by one to a carriage path 1705. A detecting section 1702 reads a pattern indicating such sorting information as a specific number or address information borne by each of the sheets forwarded one by one from said supply section 1701. A discriminating section 1703 performs processing to recognize sorting information read by said detecting section 1702, and sorts the sheets into a plurality of stacking boxes 1704 according to the result of recognition. These stacking boxes 1704 are installed inclined at a prescribed angle and in a number corresponding to the types of information to be recognized by said discriminating section 1703, and the sheets are sorted and stacked correspondingly to the result of recognition processing by the discriminating section 1703.

Next will be described the operation of this example of paper sheet sorting system.

First a plurality of sheets to be sorted and stacked are set in the paper sheet supply section 1701. The set sheets are automatically forwarded to the carriage path 1705 to undergo such procedures as foreign matter detection and detection of two stuck sheets fed together. A pattern such as a specific number or letters indicating sorting information including address information is assigned to each of the sheets in advance, and the detecting section 1702 reads the patterns borne by the sheets which are carried. Then the sheets, whose the patterns have been read by the detecting section 1702, undergo recognition by the discriminating section 1703 of the sorting information indicated by the pattern borne by each sheet, and are sorted into the corresponding stacking boxes 1704 according to the result of recognition.

Whereas the stacking boxes are inclined at a prescribed angle in this example, they can as well be horizontally installed if stacking boxes each having either the third or the fourth preferred embodiment of the present invention as its paper sheet stacking mechanism are used in this paper sheet sorting mechanism.

What is claimed is:

1. A paper sheet stacking mechanism to be installed within a stacking box into which paper sheets deposited through an input slit are to be stacked, comprising:

a movable guide place for guiding the sheets deposited through the input slit, supported by a first shaft provided on a top plate of the stacking box, pivoting on said first shaft when the volume of sheets stacked in the stacking box has surpassed a prescribed level;

a supporting plate for preventing said movable guide plate from being pivoted on said first shaft before the volume of sheets stacked in the stacking box has surpassed the prescribed level, said supporting plate having one end which pivots on a second shaft provided on the top plate and another end positioned in contact with a face of said movable guide plate opposite to the input slit; and a releasing mechanism for disengaging said movable guide plate from said supporting plate and for permitting said movable guide plate to pivot on said first shaft, when the volume of sheets stacked in the stacking box has surpassed the prescribed level.

2. A paper sheet stacking mechanism, as claimed in claim 1, wherein said movable guide plate and said supporting plate are so arranged that, in a state in which the volume of sheets stacked in the stacking box has not reached the prescribed level, said movable guide plate presses said supporting plate in a direction of said second shaft.

3. A paper stacking mechanism, as claimed in claim 1, wherein said releasing mechanism, when the volume of sheets stacked in the stacking box has surpassed the prescribed level, disengages said movable guide plate from said supporting plate by changing direction of a force which said movable guide plate presses said supporting plate.

4. A paper stacking mechanism, as claimed in claim 3, wherein said releasing mechanism is a slit so configured as to permit said first shaft to shift its position.

5. A paper stacking mechanism, as claimed in claim 3, wherein said releasing mechanism is a flip-up plate supported swingably by a third shaft provided at a free end of said movable guide plate, said flip-up plate being folded toward said supporting plate and pressing said supporting plate.

6. A paper stacking mechanism, as claimed in claim 5, wherein said movable guide plate has at its free end means for restricting the extent of swing of said flip-up plate.

7. A paper stacking mechanism, as claimed in claim 5, further comprising adjusting means for adjusting a timing of release of said movable guide plate from said supporting plate, said adjusting means being positioned at a lower end of said flip-up plate.

8. A paper stacking mechanism, as claimed in claim 1, further comprising buffer means for restricting the extent of swing of said movable guide plate, said buffer means being located in close proximity to said first shaft.

9. A paper stacking mechanism, as claimed in claim 1, further comprising adjusting means for adjusting a timing of release of said movable guide plate from said supporting plate, said adjusting means being provided at a free end of said movable guide plate.

10. A paper stacking mechanism, as claimed in claim 1, wherein said movable guide plate has its end, other than that fitted to said first shaft, folded toward said supporting plate.

11. A paper sheet sorting system comprising:

a paper sheet supply section for supplying paper sheets to a carriage path;

a detecting section for reading patterns added to sheets forwarded from said supply section;

a discriminating section for distinguishing the type of sheet according to information indicated by the pattern read by said detecting section; and a plurality of stacking boxes, each stacking box including:

a movable guide plate for guiding the sheets deposited through the input slit, supported by a first shaft provided on a top plate of the stacking box, pivoting on said first shaft when the volume of sheets stacked in the stacking box has surpassed a prescribed level;

a supporting plate for preventing said movable guide plate from being pivoted on said first shaft before the volume of sheets stacked in the stacking box has surpassed the prescribed level, said supporting plate having one end which pivots on a second shaft provided on the top plate and another end positioned in contact with a face of said movable guide plate opposite to the input slit; and a releasing mechanism for disengaging said movable guide plate from said supporting plate and for permitting said movable guide plate to pivot on said first shaft, when the volume of sheets stacked into the stacking box has surpassed the prescribed level.

* * * * *